United States Patent [19]

Crane et al.

[11] Patent Number: 4,630,387

[45] Date of Patent: Dec. 23, 1986

[54] ADJUSTABLE PISTOL GRIP

[75] Inventors: James W. Crane, Fairport, N.Y.; Ragnar Skanaker, Ångelholm, Sweden

[73] Assignee: The Coleman Company, Inc., Wichita, Kans.

[21] Appl. No.: 792,259

[22] Filed: Oct. 28, 1985

[51] Int. Cl.[4] ..... F41C 23/00

[52] U.S. Cl. ..... 42/73; 42/71.02

[58] Field of Search ..... 42/71 R, 71 P, 72, 73

[56] References Cited

U.S. PATENT DOCUMENTS 1,582,395 4/1926 Haemmerli ..... 42/73
1,651,299 11/1927 Stansel ..... 42/73
3,128,571 4/1964 Herrett ..... 42/71 P
4,300,302 11/1981 Anschütz et al. ..... 42/73
4,397,111 8/1983 Morini ..... 42/73

*Primary Examiner*—Deborah L. Kyle
*Assistant Examiner*—Ted L. Parr

[57] ABSTRACT

An adjustable pistol grip includes a palm portion and a forepiece portion which is adjustably secured to the palm portion so that the width of the grip can be adjusted. The grip is attached to the receiver of a pistol, and the grip can swivel on the receiver to adjust the angle between the grip and the barrel of the pistol. A heel plate extends laterally outwardly from the bottom portion of the grip and is adjustably secured so that the distance between the heel plate and the receiver can be adjusted.

14 Claims, 9 Drawing Figures

ADJUSTABLE PISTOL GRIP

BACKGROUND AND SUMMARY

This invention relates to pistol grips, and, more particularly, to an adjustable pistol grip whose dimensions can be changed and whose position on the pistol can be changed.

A conventional pistol grip will be a particular size and will not precisely fit the hand of all shooters. Accordingly, some shooters, particularly expert marksmen, may alter the size and shape of the grip by building up some parts of the grip with tape or the like and reducing other parts of the grip by sanding or cutting. Custom-made grips can be obtained, but such grips are considerably more expensive than standard grips.

The invention provides an adjustable grip whose size can be adjusted to fit a particular shooter's hand. The grip is adjustably attached to the receiver of the pistol so that the position of the grip relative to the barrel of the pistol can also be adjusted to the shooter's preference. The grip includes a palm portion and a forepiece portion which is adjustably secured to the palm portion so that the width of the grip in a direction generally parallel to the barrel can be adjusted. A heel plate is adjustably secured to the palm portion and to the forepiece portion so that the distance between the heel plate and the receiver can be adjusted.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
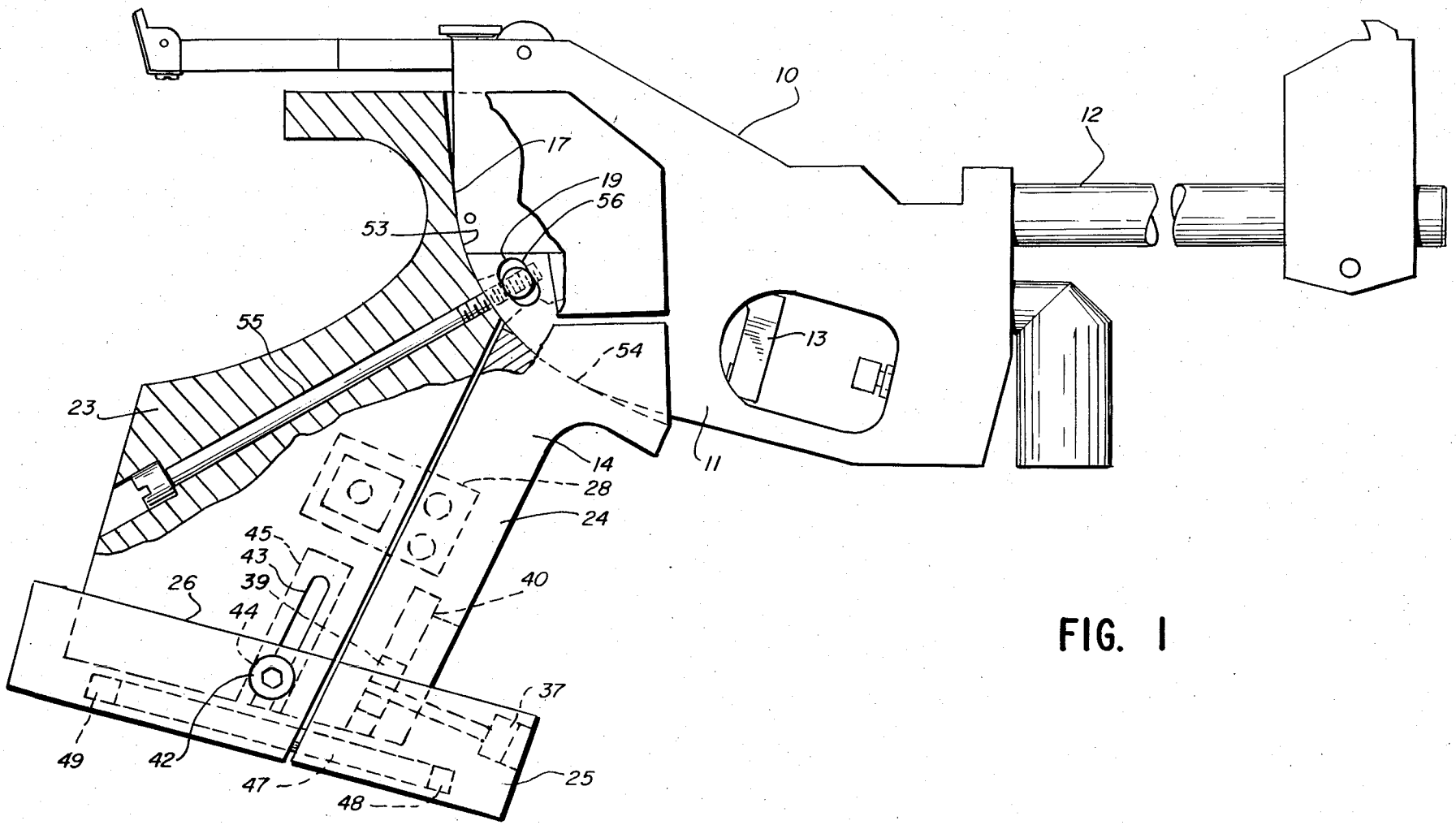
FIG. 1 is a right side elevational view, partially broken away of a pistol equipped with an adjustable pistol grip in accordance with the invention.

Referring first to FIG. 1, a pistol 10 includes a metal frame or receiver 11, a barrel 12 mounted on the receiver, a trigger 13, and a grip 14. Except for the means for attaching the grip to the receiver, the receiver can be conventional. The particular pistol illustrated in the drawings is a gas-powered pistol which fires a projectile such as a pellet with a charge of pressurized gas. However, the invention can also be used with firearms. The firing mechanism of the pistol which is activated by the trigger 13 may also be conventional, and the details thereof do not form any part of this invention.

Figure 6:
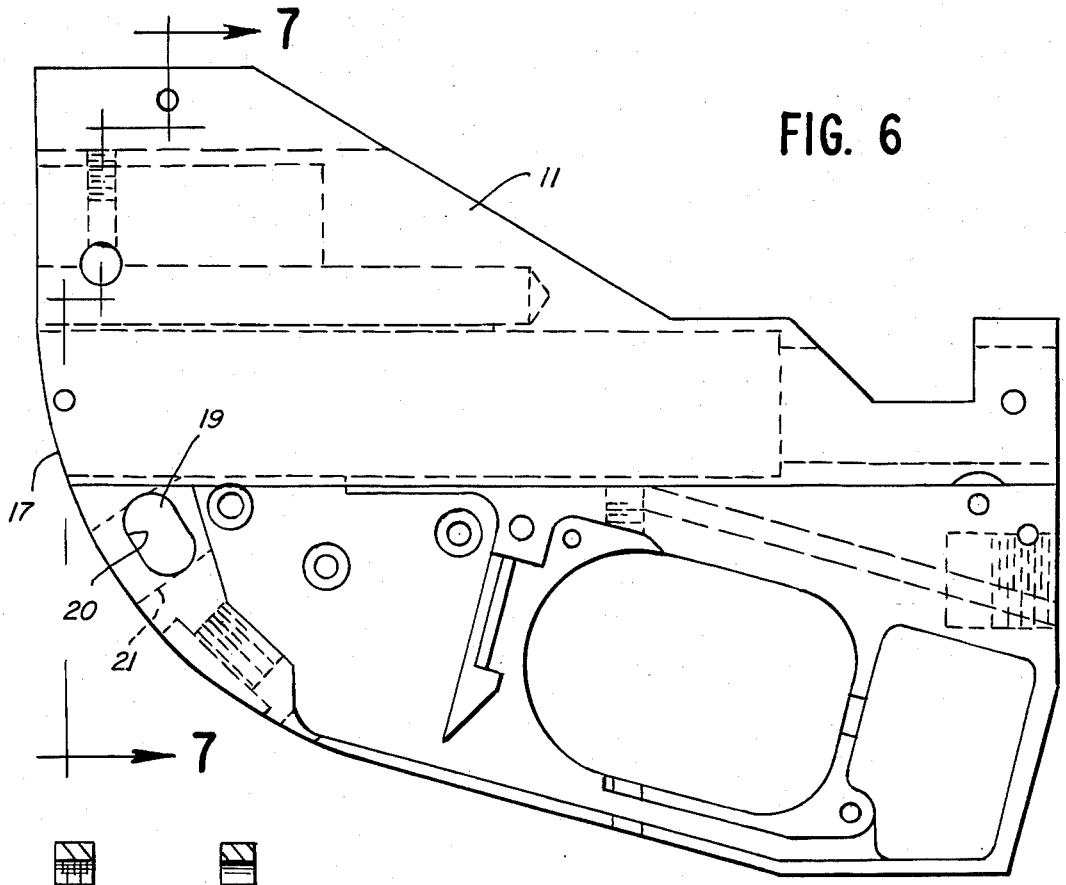
FIG. 6 is a side elevational view of the receiver of the pistol.
Figure 7:
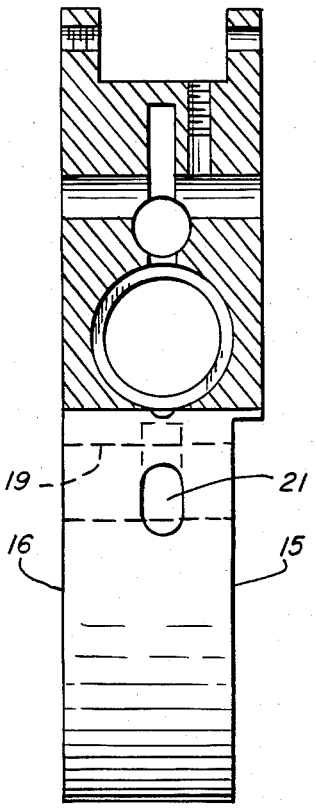
FIG. 7 is a sectional view taken along the lines 7—7 of FIG. 6.

The receiver 11 is a generally solid body which includes right and left side surfaces 15 and 16 (FIG. 7) and which is provided with various bores and recesses for the internal parts of the pistol. The rear portion of the receiver terminates in an arcuate rear surface 17 (FIG. 6).

An elongated slot 19 extends laterally through the receiver, and at least the rear surface 20 of the slot 19 is also generally arcuate about the same center as the arcuate surface 17. A second slot 21 (see also FIG. 7) extends inwardly from the rear surface 17 of the receiver between the side surfaces 15 and 16 and intersects the first slot 19.

Referring now to FIGS. 1–5, the grip 14 includes a palm portion 23 and a forepiece or finger portion 24. The palm portion 23 forms the rear part of the grip, and the palm and thumb of the shooter's hand extend around the palm portion. The fingers of the hand extend around the forepiece 24. A heel plate 25 extends laterally outwardly from the palm portion and forepiece along one side and the front and rear of the grip to provide a flat heel rest surface 26.

The forepiece 24 of the grip is slidably attached to the palm portion by a flat metal plate 28 (see particularly FIG. 5) which is secured within a slot in the forepiece by a pair of screws 29 and 30. The free end of the plate 28 is provided with a generally rectangular opening 31 and is slidable within a slot 32 in the palm portion. A clamping plate 33 is provided with a threaded opening 34 and is clamped against the plate 28 by a bolt 35 which extends through a countersunk opening 36 in the palm portion 23, through the opening 31 in the plate 28, and into the hole 34 of the clamping plate. The bolt 35 is provided with a hexagonal Allen socket head. When the bolt is tightened, the plate 28 is clamped against the inside surface of the slot 32 of the palm portion by the clamping plate 33.

Figure 2:
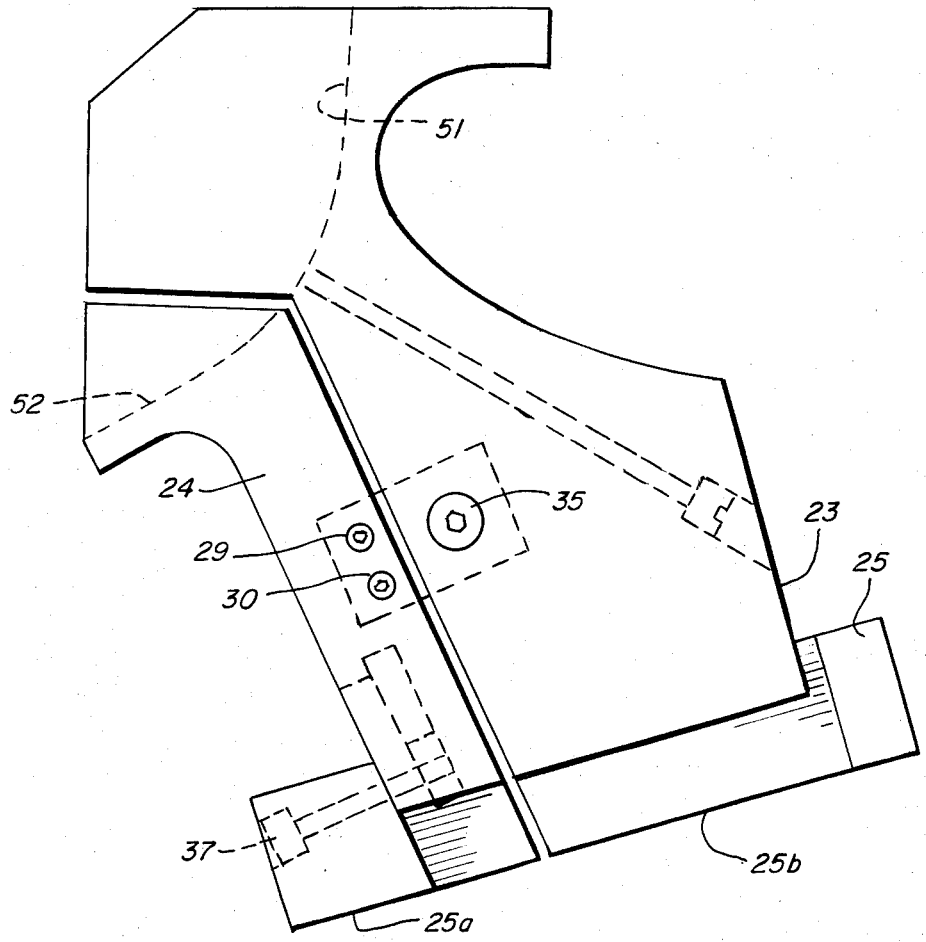
FIG. 2 is a left side elevational view of the pistol grip.
Figure 3:
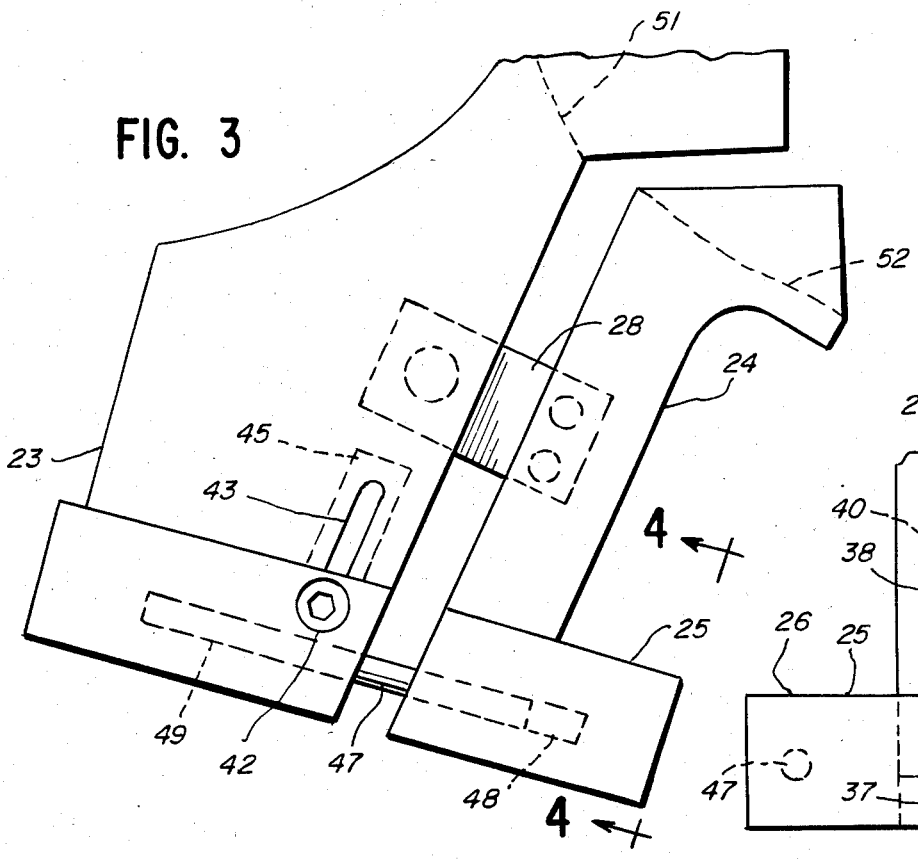
FIG. 3 is a right side elevational view of the pistol grip with the forepiece portion positioned forwardly of its position in FIG. 1.
Figure 4:
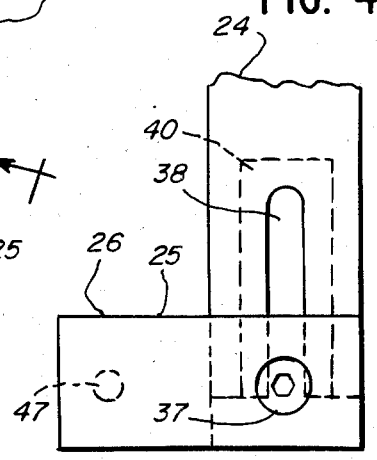
FIG. 4 is a fragmentary front elevational view taken along the line 4—4 of FIG. 3.
Figure 5:
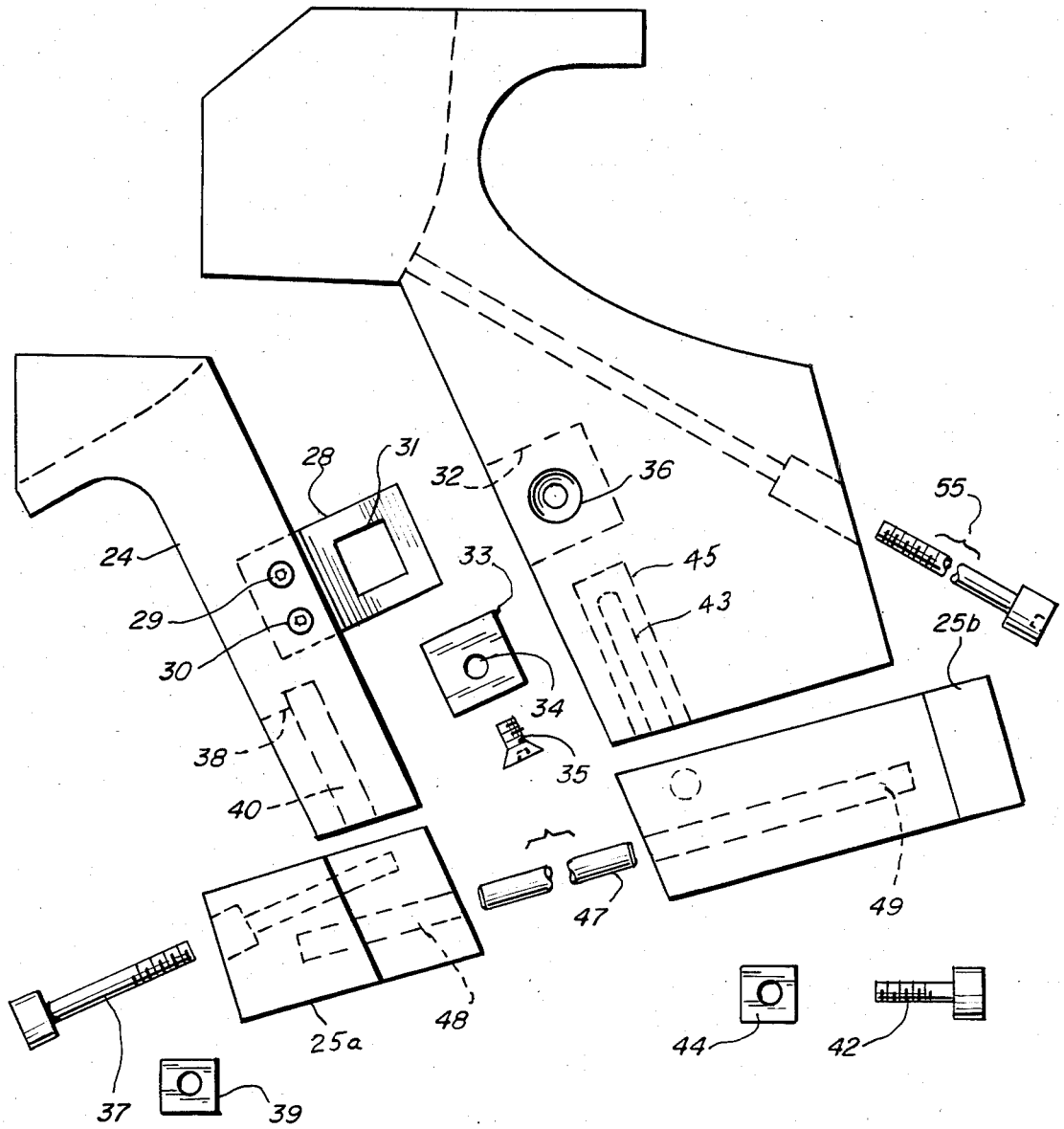
FIG. 5 is an exploded view of the pistol grip.

Comparing FIGS. 2 and 3, the forepiece portion 24 is slidable in a direction which extends generally parallel to the barrel 12 by loosening the bolt 35 and moving the slotted plate 28 relative to the bolt 35. The width of the grip in a direction generally parallel to the barrel can therefore be adjusted by adjusting the forepiece. The rectangular opening 31 in the plate 28 also permits the forepiece 24 to be tilted somewhat relative to the palm portion depending upon the shooter's preference.

The heel plate 25 is formed from a front half **25*a* (FIG. 2) which is adjustably attached to the forepiece 24 and a rear half 25*b* which is adjustably attached to the palm portion 23. The front half 25*a* is attached to the forepiece by a bolt 37 which extends through a counter bore in the front half 25*a* and into an elongated slot 38 (FIG. 4) in the front of the forepiece. The end of the bolt is threadedly engaged with a cylindrical plug 39 (FIG. 5) which is slidable within a cylindrical bore 40 behind the elongated slot 38**.

The rear half **25*b* of the heel plate is attached to the palm portion 23 by a bolt 42 (FIG. 3) which extends laterally through a counter bore in the rear half and into an elongated slot 43 in the side of the palm portion. The end of the bolt is threadedly engaged with a cylindrical plug 44 (FIG. 5) which is slidable within a cylindrical bore 45 behind the elongated slot 43**.

The distance between the heel plate and the receiver can be adjusted by loosening the bolts 37 and 42 (FIGS. 3 and 4) and sliding the two halves of the heel plate upwardly or downwardly relative to the receiver.

When the forepiece portion 24 is adjusted relative to the palm portion 23, the front and rear halves **25*a* and 25*b* of the heel plate are constrained to slide relative to each other in a direction parallel to the sliding movement of the forepiece by a cylindrical rod 47 which is slidably mounted within bores 48 and 49** inside the two halves.

Figure 8:
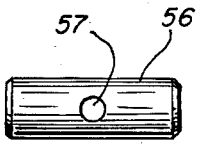
FIG. 8 is a side view of the swivel bolt for attaching the pistol grip to the receiver.
Figure 9:
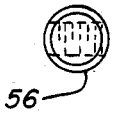
FIG. 9 is an end view of the swivel bolt.

The upper end of the palm portion 23 and the forepiece 24 are provided with recesses 51 and 52, respectively, between the side surfaces thereof, and the lower surfaces of the recesses are provided with arcuate surfaces 53 and 54, respectively (see FIG. 1) which mate with the arcuate surface 17 of the receiver. The grip is attached to the receiver by an elongated bolt or screw 55 which extends through a countersunk bore in the palm portion 23. The threaded end of the bolt extends into the slot 21 in the receiver and is threadedly engaged with a cylindrical plug 56 which is positioned within the slot 19 in the receiver. The plug 56 has a threaded opening 57 (FIG. 8) into which the bolt is screwed.

The length of the cylindrical plug 56 is approximately the same as the width of the receiver, and as the bolt 55 is screwed into the plug, the plug is drawn against the rear surface 20 of the slot 19, and the arcuate surface 53 of the palm portion 23 is drawn against the arcuate surface 17 of the receiver. When the bolt is tightened, the grip is clamped to the receiver.

Different shooters have different shooting styles with respect to the angle between the wrist and the barrel of the gun. For example, some shooters prefer to hold the wrist in an uncocked position in which the grip extends almost perpendicularly to the forearm. Other shooters prefer to cock the wrist so that the grip extends at an angle of about 45° to the forearm. In each case, the barrel of the gun is generally parallel to the forearm as the shooter sights down the barrel.

The angle between the grip 23 and the barrel 12 can be varied by loosening the bolt 55 and swiveling the bolt and the plug 56 in the slots 21 and 19, respectively. When the desired angular relationship between the grip and the barrel is obtained, the bolt 55 is tightened to secure the grip on the receiver. The position of the grip relative to the barrel can therefore be adjusted to accommodate an individual shooter's preference.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A grip for a pistol having a receiver and a barrel, the grip having a width dimension which extends generally parallel to the barrel, comprising:

a palm portion adapted to be gripped by the palm and thumb of a user, a forepiece portion adapted to be gripped by the fingers of the user, means for adjustably securing the forepiece to the palm portion so that said width dimension of the grip can be varied by moving the forepiece relative to the palm portion, and means for attaching the grip to the receiver.

2. The grip of claim 1 including a heel plate extending laterally outwardly from the palm portion and the finger portion and being adjustably secured thereto so that the distance between the heel plate and the receiver can be varied.

3. The grip of claim 2 in which the heel plate includes a rear portion adjustably secured to the palm portion and a front portion adjustably secured to the forepiece portion and guide means extending between the front and rear portion of the heel plate and slidably mounted therein.

4. The grip of claim 3 in which the rear portion of the heel plate is adjustably secured to the palm portion by a screw which extends through the rear portion and into an elongated slot in the palm portion and the front portion of the heel plate is adjustably secured to the forepiece portion by a screw which extends through the front portion and into an elongated slot in the forepiece portion.

5. The grip of claim 3 in which the guide means is a metal rod.

6. The grip of claim 1 in which the forepiece portion is adjustably secured to the palm portion by a plate which is secured to the forepiece portion and which is slidable within a slot in the palm portion, and means for securing the plate within the slot.

7. The grip of claim 6 in which said plate is provided with an elongated slot and said means for securing the plate includes a screw extending from the outside of the palm portion through the slot in the plate and into a clamp whereby the plate can be secured by tightening the screw to draw the clamp against the plate.

8. The grip of claim 1 in which the means for attaching the grip to the receiver includes a bolt extending through the palm portion and into the receiver, and swivel means connected to the bolt for permitting the grip to swivel in a plane which extends parallel to the barrel.

9. The grip of claim 8 in which the swivel means comprises a rod which is positioned within a slot in the receiver, the bolt being threadedly engaged with the rod.

10. The grip of claim 9 in which said slot in the receiver extends through the receiver generally perpendicularly to the barrel, the bolt extending through a second slot in the receiver which extends generally perpendicular to, and intersects, the first slot.

11. The grip of claim 8 in which the receiver includes an arcuate surface adjacent the grip and the grip includes a mating arcuate surface which abuts the arcuate surface of the receiver.

12. The grip of claim 11 in which the forepiece portion is adjustably secured to the palm portion by a plate which is secured to the forepiece portion and which is slidable within a slot in the palm portion, a clamp in the slot in the palm portion adjacent the plate, and a screw extending from outside of the palm portion through the slot in the plate and into the clamp whereby the plate can be secured by tightening the screw to draw the clamp against the plate.

13. The grip of claim 8 in which the forepiece portion is adjustably secured to the palm portion by a plate which is secured to the forepiece portion and which is slidable within a slot in the palm portion, a clamp in the slot in the palm portion adjacent the plate, and a screw extending from outside of the palm portion through the slot in the plate and into the clamp whereby the plate can be secured by tightening the screw to draw the clamp against the plate.

14. The grip of claim 13 including a heel plate extending laterally outwardly from the palm portion and the finger portion and being adjustably secured thereto so that the distance between the heel plate and the receiver can be varied.

* * * * *